United States Patent [19]

Thomas

[11] 4,226,044

[45] Oct. 7, 1980

[54] DRIVE-IN TELLER COIN BANK

[75] Inventor: Ulrich H. Thomas, Bellwood, Ill.

[73] Assignee: Banthrico Inc., Chicago, Ill.

[21] Appl. No.: 968,510

[22] Filed: Dec. 11, 1978

[51] Int. Cl.[3] ..... A63H 33/00

[52] U.S. Cl. ..... 46/4; 46/202

[58] Field of Search ..... 46/4, 5, 3, 2, 218, 46/202

[56] References Cited

U.S. PATENT DOCUMENTS

| | | | |
|---|---|---|---|
| 214,921 | 4/1879 | Johnson | 46/4 |
| 1,918,691 | 7/1933 | Eschenbacher | 46/4 |
| 2,290,844 | 7/1942 | Smith | 46/218 |
| 4,079,540 | 3/1978 | Boyett et al. | 46/4 |

*Primary Examiner*—Louis G. Mancene
*Assistant Examiner*—Mickey Yu
*Attorney, Agent, or Firm*—Wallenstein, Spangenberg, Hattis & Strampel

[57] ABSTRACT

A coin bank comprises a vehicle movable horizontally along an appreciable portion of the length of a support base, the vehicle having a coin-receiving slot in the top thereof. The vehicle interior has a pivotably mounted coin-receiving member which receives a coin, preferably vertically oriented, inserted through this slot. When this vehicle is moved to one extreme end of the path of travel of the vehicle, the coin-receiving member in the vehicle engages a cam surface which pivots the same at right angles to the direction of movement of the vehicle, to throw the coin into a preferably vertical slot in a vertical wall behind the vehicle. Preferably, the vertical coin slot-containing portion of the vertical wall is depicted as a teller's station in a bank. A roof-forming wall overlies the support base at the bank teller's station so that a coin cannot be placed in the top of the vehicle thereat. The coin slot in the vehicle is uncovered when it is at the opposite end of the support base.

15 Claims, 10 Drawing Figures

DRIVE-IN TELLER COIN BANK

BACKGROOUND OF INVENTION

The present invention relates to coin banks of the type wherein a coin is placed in a coin-insertion member which is movable on a support base into a coin-ejecting position where the coin enters a slot in a wall of the bank where it drops into a coin storage compartment sometimes depicted in the form of a house or other building. Examples of such toy banks are shown in U.S. Pat. Nos. 1,918,691 and 4,079,540. The coin-insertion members of these prior coin banks have taken a variety of forms, such as human beings and animals. The configuration of the bank housings which receive the coins from the coin-insertion members have also taken a variety of forms, including buildings and other structures.

One object of the present invention is to provide a coin bank with a unique and interesting configuration of and relationship between the coin-insertion member and the coin-receiving portion of the bank housing. A related object of the invention is to provide such a coin bank which can be constructed in an economical manner in an assembled condition for sale to the ultimate purchaser.

SUMMARY OF THE INVENTION

The coin bank is most desirably designed to appear like a drive-in bank having a roadway for a coin-receiving vehicle movable horizontally across the front of the coin bank. The roadway may be formed by an exposed horizontal wall at the top of a front support base portion of the coin bank housing. The coin-receiving vehicle has a slot therein, preferably in the top thereof oriented in a direction transverse to the direction of movement of the vehicle. The vehicle is mounted for horizontal movement across the support base at the front of the bank between a coin-receiving position near one end of this roadway-forming wall and a coin-ejecting position near the other end of the roadway-forming wall. The coin bank housing has a rear coin storage compartment-forming portion behind the roadway-forming wall which portion has a vertical wall extending upwardly behind the roadway-forming wall. This vertical wall has a coin-receiving slot above one end of the roadway-forming wall through which opening a coin passes into a coin storage compartment behind the wall when a coin is ejected from the vehicle thereat.

While the vehicle can be moved directly by hand over the horizontal path of travel described, it may preferably be moved by a handle on the outside of a front vertical wall of the support base. In such case, this handle is connected to a carriage or slide mounted beneath said horizontal roadway-forming wall through a horizontal slot in this front vertical wall and making connection with the vehicle through a longitudinal slot formed in the horizontal roadway-forming wall. The coin-receiving vehicle is thus moved from one end to the other of the roadway-forming wall by grasping the handle and moving it along the slot in the front vertical wall of the support base.

In accordance with another feature of the invention, the coin slot-containing vertical wall has indicia adjacent to the coin-receiving slot therein which makes it appear like a teller's station in a drive-in bank. This vertical wall may also be provided along other portions thereof with an advertisement sign-receiving portion adapted to receive a decal or the like identifying a bank or other business organization which may give the coin bank of the invention away as a free premium item.

In accordance with a specific feature of the invention, the coin-receiving vehicle has a narrow, vertically extending guideway for receiving the coin inserted into the vehicle. Mounted for pivotal movement in the bottom portion of this guideway is a coin-ejecting member which has a curved upper surface which extends around the bottom and forwardly facing edges of the coin. The coin-ejecting member is pivoted at its rear-end and is provided with a cam follower-forming projection extending therefrom which engages a cam surface projecting upwardly from the end of the roadway-forming wall of the support base adjacent to the coin-receiving slot in the vertical wall of the rear coin storage-forming portion of the coin bank housing. When the coin-receiving vehicle is moved over this upwardly extending cam, the cam follower-forming projection is moved upwardly to pivot the coin-ejecting member in a direction which throws the coin out of an aperture in the vehicle and into the coin-receiving slot of the latter vertical wall.

A subsidiary feature of the coin bank is the provision of a roof-forming wall overhanging the support base opposite the teller's station of the bank so that a coin cannot be dropped into the top of the coin-receiving vehicle where the coin-receiving slot is preferably located when it is positioned adjacent to the teller station. The top of the vehicle is, however, uncovered when the vehicle is located at the opposite end of this support base, so that even young children will have no difficulty in operating the vehicle in a manner to effect ejection of the coin into the slot at the teller's station of the coin bank, which requires that the vehicle be moved opposite the teller's station with some speed so that the coin-ejecting member can fling the coin into the coin-receiving slot at the teller's station.

The previously described and other objects, advantages and features of the invention will become apparent upon making reference to the specification to follow, the claims and the drawings.

DESCRIPTION OF EXEMPLARY EMBODIMENT OF THE INVENTION

Figure 4:
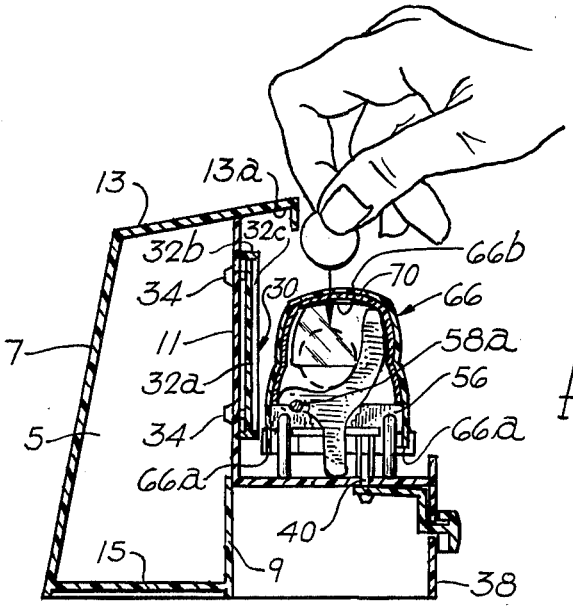
FIG. 4 is a transverse sectional view through the vehicle coin-receiving station portion of the bank, taken along section line 4—4 in FIG. 2, the figure showing a coin being inserted into a slot at the top of the vehicle.

Referring now to the drawings, there is shown a coin bank generally indicated by reference numeral 1 and which includes a housing generally indicated by reference numeral 3 having a vehicle support base portion 3A at the front thereof and a coin storage compartment-forming portion 3B at the rear thereof. The coin storage compartment-forming portion 3B of the housing extends substantially the full height of the coin bank and defines a coin storage compartment 5 (FIG. 4) formed by a slightly forwardly and upwardly inclining rear wall 7, a lower front vertical wall 9 joining a slightly forwardly offset, generally exposed, forwardly-facing upper vertical wall 11, the rear portion of a forwardly and upwardly inclining top wall 13, a bottom wall 15 and the rear, vertical-elongated portions 17*a*—17*a* of L-shaped side walls 17—17 of the housing. The top wall 13 has a front portion 13*a* which overlies one end of the exposed upper side of the vehicle support base portion 3A of the housing and forms an overhanging roof over the end of the support base therebelow.

Figure 5:
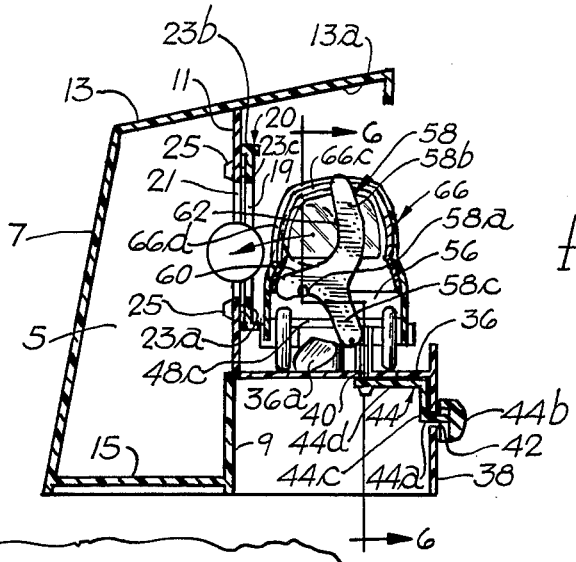
FIG. 5 is a fragmentary horizontal sectional view through the teller's station portion of the coin bank, taken along section line 5—5 in FIG. 2 as a coin is ejected from the coin-receiving vehicle thereat.
Figure 9:
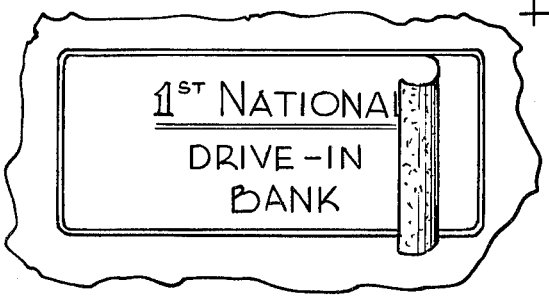
FIG. 9 is an enlarged fragmentary view showing a bank-identifying label being applied to the advertising sign-forming portion of the coin bank.

Secured to the upper vertical wall 11 of the coin storage-forming portion 3B of the housing below the front top wall portion 13*a* overlying the support base 3A is a teller's station-forming insert member 20 with a vertical coin-receiving slot 19 therein aligned with a corresponding vertical slot 21 formed in the upper vertical wall 11, so that a coin passing through the aligned slots 19–21 will fall into the coin storage compartment 5. The teller's station-forming insert member may comprise a body of synthetic plastic material having a central vertical wall portion 23*a* (FIG. 5) in which the slot 19 is formed, from which wall extends anchoring pins 25 which pass through correspondingly mounted holes in the upper vertical wall 11. The ends of the pins 25 are enlarged to form a rivet-like anchoring means for holding the insert member 20 in place on the wall 11. Extending transversely forwardly and rearwardly from the margins of the wall portion 23*a* is a peripheral flange 23*b* which forms a decal-receiving recess 23*c* on the front side of the wall portion 23*a*. This peripheral flange contacts the front face of the upper vertical housing wall 11. A teller's station-forming decal 26 with a pressure sensitive adhesive layer on the rear side thereof is secured by the adhesive upon the insert member wall portion 23*a*. The front face of the decal has bank teller station-forming indicia 26*a* thereon stradling a slot 26*b* aligned with the wall slots 19 and 21.

A preferably horizontally elongated advertising sign-forming insert member 30 is mounted on the front side of the upper vertical wall 11 of the housing. This insert member may comprise a body of synthetic plastic material with a central vertical wall portion 32*a* from the margins of which transversely forwardly and rearwardly extend a peripheral flange 32*b* which define a decal-receiving recess 32*c* on the front thereof. The rear end of the peripheral flange 32*b* contacts the front face of the upper vertical housing wall. The insert member 30 is anchored to the wall 11 by pins 34 which pass through openings in the wall 11 where they are enlarged to form rivet-like anchoring means for the insert member 30. An advertising sign-forming decal 35 is provided which has pressure sensitive coating on the rear side thereof which anchors this decal upon the vertical wall portion 32*a* within the recess 32*c*. The outer face of the decal has indicia 34*a* which identifies a bank or other organization which is selling or giving away the coin bank 1.

The vertical wall 11 and the decal-carrying teller's station-forming insert member 20 and the advertising sign-forming insert member 30 mounted thereon thus appear to be like a miniature outer wall of a drive-in bank, with an overhanging roof formed by the front top wall portion 13*a* above the teller's station. The top of the vehicle support base 3A which extends in front of and beneath this portion of the coin bank forms what appears to be a roadway passing in front of the same across the exposed front of the coin bank.

Figure 1:
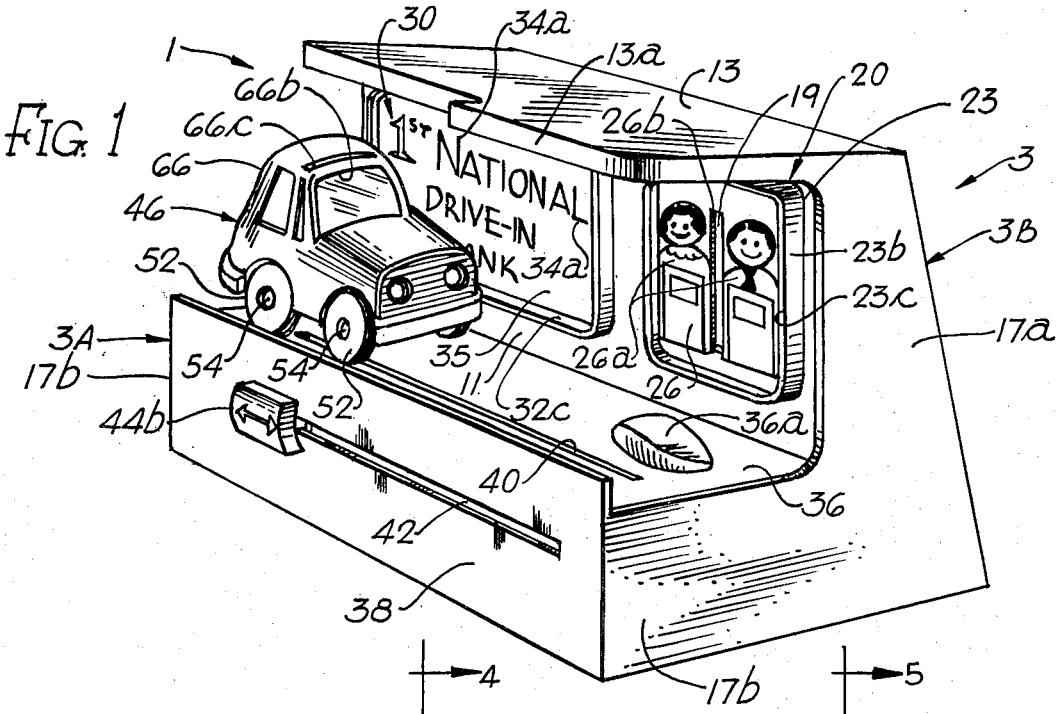
FIG. 1 is a perspective view of the preferred form of coin bank of the present invention.
Figure 2:
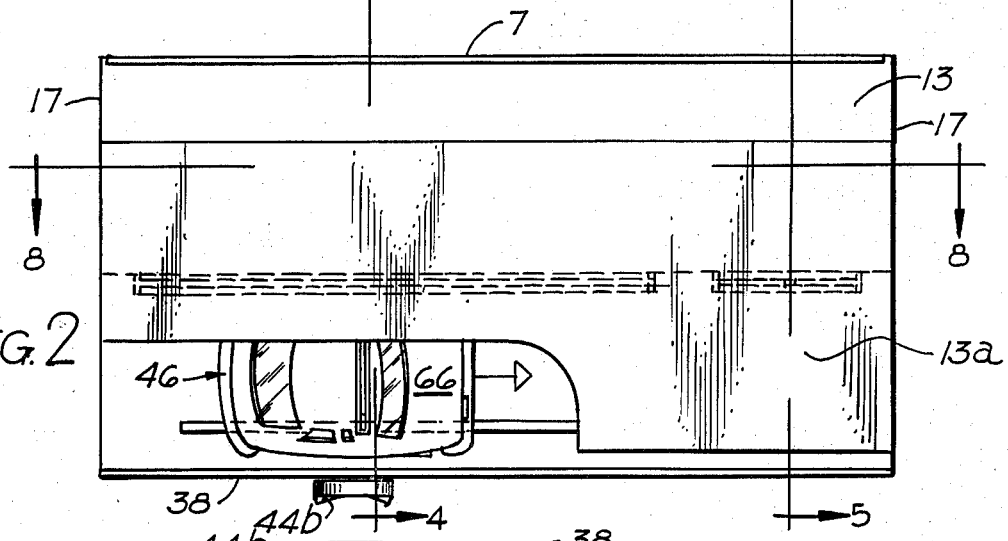
FIG. 2 is a top plan view of the bank of FIG. 1.

The support base 3A is formed by the forwardly extending portions 17*b*—17*b* of the L-shaped side walls 17—17 of the housing, a roadway-forming, horizontally elongated wall 36 extending between the upper extremities of the side wall portions 17*b*—17*b*, and a vertical front wall 38 extending between the front edges of the side wall portions 17*b*—17*b*. The vertical wall 38 preferably extends slightly above the roadway-forming wall 36 to form a skirt. Extending upwardly from the roadway-forming wall 36 in front of the teller's station-forming insert member 20 is a cam-forming projection 36*a*. The roadway-forming wall 36 also has a longitudinal slot 40 therein running for most of the length of the same. The vertical front wall 38 of the support base 3A has a correspondingly long longitudinal slot 42 therein. Slidably mounted within the slot 42 is a carriage or slide member 44, best shown in FIGS. 3 and 5, for supporting a coin-receiving vehicle 46 for movement above the roadway-forming wall 36 between a coin-receiving position as shown in FIG. 1 adjacent one end portion of the support base opposite the sign-forming insert member 30 and a coin ejecting position thereon adjacent the teller's station-forming insert member 20. The carriage or slide member 44, which may be made of a molded synthetic plastic material, includes a horizontal bottom forward portion 44*a* passing through the front wall slot 42 and terminating in a handle-forming portion 44*b* on the front of the wall 38. The wall portion 44*a* joins an intermediate portion 44*c*, in turn, joining a rearwardly extending horizontal portion 44*d* positioned immediately below the slotted portion of the roadway-forming wall 36.

Figure 6:
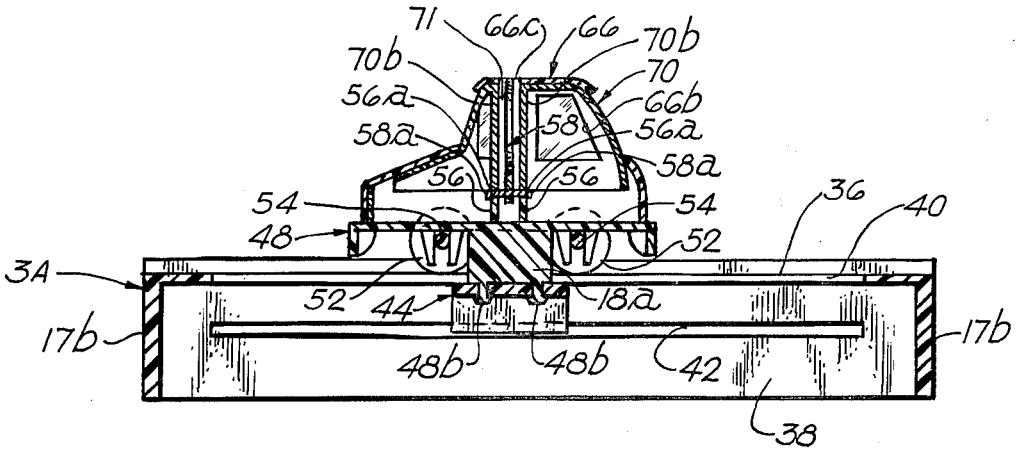
FIG. 6 is a transverse vertical sectional view through the coin-ejecting station of the bank, taken along section line 6—6 in FIG. 5.
Figure 7:
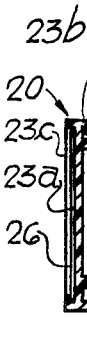
FIG. 7 is a vertical sectional view through the coin bank, taken along section line 7—7 in FIG. 8.
Figure 8:
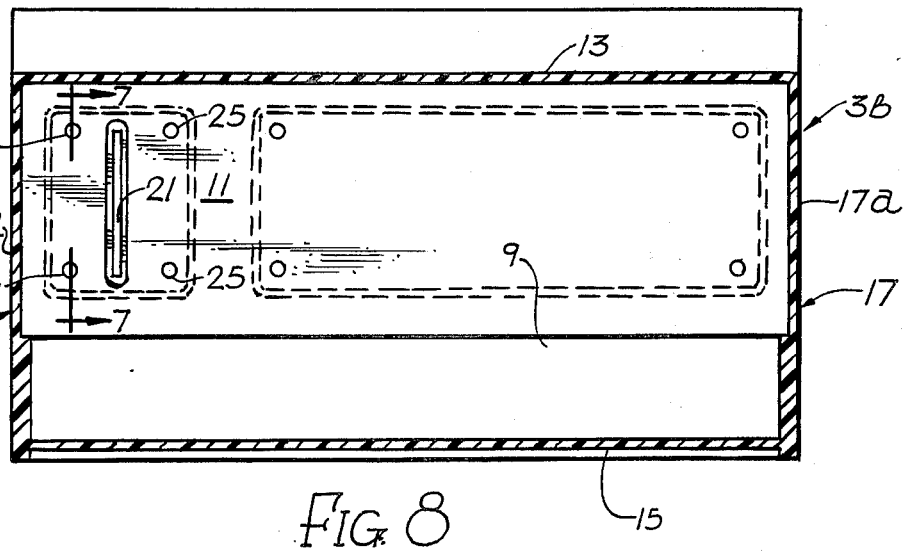
FIG. 8 is a longitudinal vertical sectional view through the coin bank, taken along section line 8—8 in FIG. 2.

In the illustrated form of the invention, the coin-receiving vehicle 46 has a chassis-forming portion 48 which may be made of a single piece of molded synthetic plastic material and which includes a depending leg 48*a* (see FIG. 6) which passes through the roadway-forming wall slot 40 and terminates in a pair of longitudinally spaced pins 48*b*—48*b*. The pins pass through openings in the carriage member wall portion 44*d* where they are enlarged to form rivet-like anchoring means for the coin-receiving vehicle 46. Front and rear pairs of wheels 52—52 with associated axles 54—54 are rotatably mounted upon the chassis-forming body 48, the wheels preferably rollingly enaging the upper face of the roadway-forming wall 36.

Extending upwardly from the top of the chassis-forming body 48 are a pair of transversely extending, closely spaced walls 56—56 (FIG. 6) forming a pocket for receiving a coin-receiving and ejecting member 58. The walls 56—56 have aligned recesses 56*a*—56*a* at the end thereof adjacent to the ends thereof nearest the housing wall 11, to form pivot-forming seats for pins 58a—58a extending from opposite sides of the coin-receiving and ejecting member 58. The member 58 has a coin-seating upper portion 58b (FIG. 5) with an initially upwardly facing edge portion 60 and a rearwardly horizontally facing portion 62, the edge portions 60 and 62 together forming merging curved edges. The coin-receiving and ejecting member 58 has a depending cam follower-forming portion 58c which projects downwardly through an aperture 48c in the chassis-forming body 48 where it can engage the cam-forming projection 36a. This cam-forming projection is shaped so that when the chassis-forming body 48 of the vehicle 46 is moved rapidly from the coin-receiving position shown in FIG. 1 to the coin-ejecting position in FIGS. 5 and 6, the cam follower-forming portion 58c will be pivoted in a direction where the initially upwardly and rearwardly facing edges 60 and 62 of the member 58 will fling a coin 61 through the vertical slots 19 and 21 and into the coin storage compartment 5 of the bank.

The chassis-forming body 48 of the vehicle has anchored to the top thereof a vehicle body-forming member 66, which may be a single piece of molded synthetic plastic material. The body-forming member 66 may be anchored to the chassis-forming member 48 in any suitable way, such as by pins 66a (see FIG. 4) passing through the corresponding apertures in the body 48 and enlarged to form rivet-like anchoring means. The body-forming member 66 is preferably provided with an inner liner 70 of transparent synthetic plastic material which includes various wall portions passing over window-forming apertures like 66b of the body-forming member 66, to form what appears to be transparent windows for the vehicle. The liner 70 may be secured to the inner surface of the body-forming member 66 in any suitable way, as by anchoring pins extending from the body 66 and passing through the liner 70. Also, the inner liner 70 has a pair of longitudinally spaced, laterally extending walls 70b—70b (FIG. 6) defining a coin guideway 71. The walls 70b—70b, in addition to guiding a coin into position on the coin-receiving and ejecting member 58, also retains such member in a fixed plane within the vehicle 64. The body-forming member 66 has a coin-receiving slot 66c (FIG. 5) in the top wall thereof and in alignment with the coin guideway 71, and a slot 66d in the rearwardly facing side of the body-forming member 66 which connects with and is in alignment with the slot 66c. The slot 66d forms an exitway for the coin when it is flung by the pivoted coin-receiving and ejecting member 58.

Figure 3:
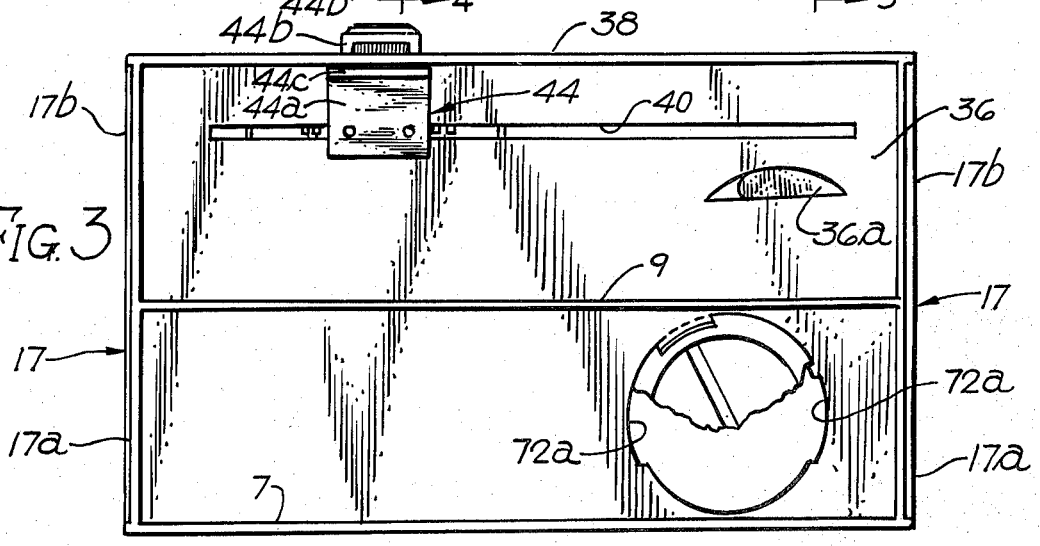
FIG. 3 is a bottom view of the coin bank of FIG. 1.
Figure 10:
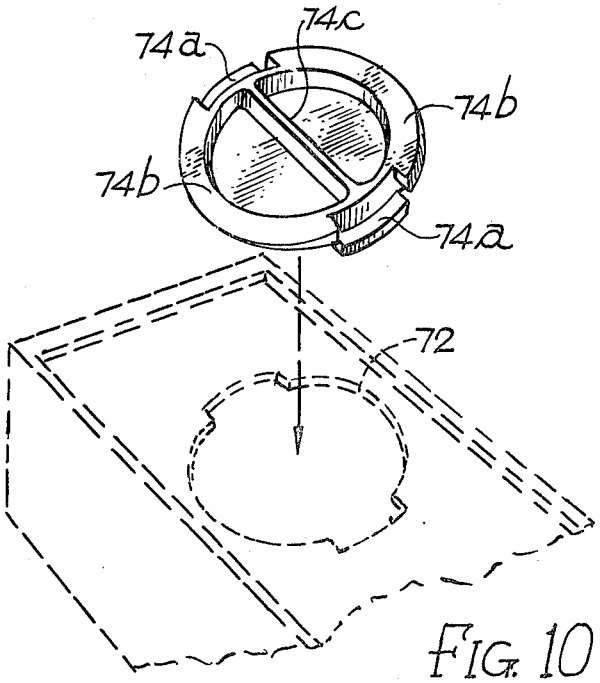
FIG. 10 is a perspective view of the closure cap which fits over the opening in the bottom wall of the coin storage compartment of the coin bank.

The rear coin storage-forming portion 3B of the housing 3 provides a substantial space for collection of coins. These coins are removed from this storage compartment through a relatively large circular opening 72 formed in the bottom wall 15 (FIG. 3). This opening has arcuate, diametrically opposed enlarged portions 72a—72a adapted to receive correspondingly shaped wings 74a—74a of a closure cap 74 (FIG. 10). The cap has flanges 74b—74b which together with the wings 74a—74a form a bayonet-type fitting for securing the closure cap 74 in the opening 72. The closure cap has an exposed gripping rib 74c for enabling the user to conveniently grasp the closure cap for insertion to and removal from the circular opening 72 in which it is mounted.

The manner in which the coin bank is best used can be described as follows: First of all, the handle-forming portion 44b is grasped and moved to the left to bring the vehicle 46 to the coin-receiving position opposite the advertising sign-forming insert member 30. The vehicle coin-receiving and ejecting member 58 is then oriented by force of gravity into the position shown in FIG. 4, where the cam follower-forming portion 58c thereof is vertical and the upwardly and rearwardly facing edges 60 and 62 thereof are in position to seat a coin dropped into the slot 66c in the top of the vehicle. A coin oriented with its faces thereof extending vertically and transversely to the direction of movement of the vehicle 46 is then inserted into the slot 66c in the top of the vehicle 46 where the coin is guided by the coin guideway 71 upon the edges 60 and 62 of the coin receiving and ejecting member 58. The handle-forming portion 44b is then grasped and moved rapidly to its extreme right hand position where the upwardly projecting cam surface 36a engages the cam follower-forming portion 58c of the coin-receiving and ejecting member 58c, so that the coin is flung from the vehicle and through the slots 66d, 19 and 21 respectively of the vehicle 46, wall portion 23a and wall 11 into the coin storage compartment 5.

All of the parts of the bank described may be made of inexpensive molded synthetic plastic material, except for the decals 24 and 34. The bank can thus be made as a give away premium item. The configuration and relation of the parts of the bank described and the manner in which the vehicle 46 relates to and is moved upon the support base 3A form a very attractive, interesting and easy-to-operate coin bank for children as well as adults.

It should be understood that numerous modifications may be made in the preferred form of the invention just described without deviating from the broader aspects of the invention.

I claim:

1. A coin bank comprising: a coin bank housing including a front support base and a rear portion defining a coin storage compartment behind said support base, said rear portion including a forwardly facing vertical wall extending along and mounted for movement along the top of said front support base in a direction parallel to the front of the coin bank and from a coin-receiving position adjacent one end portion thereof to a coin-ejecting position adjacent the opposite end portion thereof, said vehicle having a coin-receiving means to receive a coin when the vehicle is in said coin-receiving position and a coin-receiving slot oriented to receive a coin held in a vertical plane extending transversely to the direction of movement of said vehicle over said support base through which slot the coin drops onto said coin-receiving means, a coin-receiving opening in said vertical wall in the form of a vertical slot at the rear of said support base and positioned to receive a coin ejected from said vehicle when in said coin-ejecting position; and means responsive to the movement of said vehicle to said coin-ejecting position for imparting movement to said coin-receiving means therein to eject the coin from the side of the vehicle facing said vertical wall into said coin-receiving opening therein where the coin falls into said coin storage compartment.

2. The coin bank of claim 1 wherein said vertical wall at the rear of said support base adjacent to said coin-receiving opening has ornamentation thereon presenting the appearance of a bank teller's station.

3. The coin bank of claim 2 wherein said vertical wall has advertising sign-forming means thereon.

4. The coin bank of claim 3 wherein said advertising sign-forming means defines a forwardly facing recess into which an advertising decal can be inserted.

5. The coin bank of claim 2 wherein said ornamentation represents at least one teller.

6. The coin bank of claim 1 wherein there is mounted on said vertical wall advertising sign-forming means which includes a decal with indicia identifying the origin of the bank.

7. The coin bank of claim 1 wherein there is mounted on said vertical wall a sign-forming member having a recess on the front thereof for receiving a decal with indicia identifying the origin of its bank.

8. A coin bank comprising: a coin bank housing including a front support base and a rear portion defining a coin storage compartment behind said support base, said rear portion including a forwardly facing vertical wall extending along and above the rear of said support base; a coin-receiving vehicle mounted for movement along the top of said front support base in a direction parallel to the front of the coin bank and from a coin-receiving position adjacent one end portion thereof to a coin-ejecting position adjacent the opposite end portion thereof, said vehicle having a coin-receiving means to receive a coin when the vehicle is in said coin-receiving position and a coin-receiving means and a coin-receiving slot oriented to receive a coin held in a vertical plane extending transversely to the direction of movement of said vehicle over said support base through which slot the coin drops onto said coin-receiving means, said coin-receiving means in said vehicle being pivotally mounted for movement about a pivot axis at the rear thereof extending parallel to the direction of movement of said vehicle over said support base and having upwardly and rearwardly facing surfaces adapted initially to engage and receive the bottom and forwardly facing edges of said coin, said coin-receiving means also having a cam follower-forming portion depending therefrom at a point in front of said pivot axis; a coin-receiving opening in said vertical wall in the form of a vertical slot at the rear of said support base and positioned to receive a coin ejected from said vehicle when in said coin-ejecting position and said support base of said housing having a cam-forming means projecting upwardly therefrom so as to engage said cam follower portion of the vehicle when said vehicle is in said coin-ejecting position, to effect the pivoting of said coin-receiving means in a direction where said initially upwardly and rearwardly facing surfaces thereof will eject the coin from said vehicle and into said coin-receiving opening in said vertical wall.

9. The coin bank of claim 8 wherein said vehicle has a coin-receiving slot in the top thereof oriented in a vertical plane extending transversely to the direction of movement of said vehicle over said support base, and a pair of closely spaced vertical guide walls parallel to said vertical plane defining a guideway aligned with said slot in the top of the vehicle for guiding said coin into position upon said coin-receiving means.

10. The coin bank of claim 8 wherein there is provided a coin-receiving slot in said vehicle and guideway-forming wall means forming guideways for guiding a coin between the slot and said coin-receiving means.

11. The coin bank of claim 10 wherein said guideway-forming wall means also forms a means for retaining said coin-receiving means in a given plane within the vehicle.

12. A coin bank comprising: a coin bank housing including a front support base and a rear portion defining a coin storage compartment behind said support base, said support base including a top horizontal wall elevated from the bottommost portion of the housing which wall has a slot extending longitudinally thereof, said rear portion including a forwardly facing vertical wall extending along and above the rear of said support base; a coin-receiving vehicle mounted for movement along the top of said front support base in a direction parallel to the front of the coin bank and from a coin-receiving position adjacent one end portion thereof to a coin-ejecting position adjacent the opposite end portion thereof, said vehicle having a coin-receiving means to receive a coin when the vehicle is in said coin-receiving position; carriage means for said vehicle which carriage means is mounted for reciprocating movement along said horizontal wall and including a portion beneath the same which portion is connected to the bottom portion of said vehicle, said front support base of the housing having a front vertical wall extending downwardly below the front of said roadway-forming wall and having a horizontal slot therein, a handle-forming portion on the front of said front vertical wall which handle-forming portion connects with said carriage means so that said vehicle can be moved between said coin-receiving and coin-ejecting positions over said horizontal wall by grasping said handle-forming portion and moving the same along said horizontal slot in said front vertical wall; a coin-receiving opening in said vertical wall at the rear of said support base and positioned to receive a coin ejected from said vehicle when in said coin-ejecting position; and means responsive to the movement of said vehicle to said coin-ejecting position for imparting movement to said coin-receiving means therein to eject the coin from the side of the vehicle facing said vertical wall into said coin-receiving opening therein where the coin falls into said coin storage compartment.

13. The coin bank of claim 12 wherein said vehicle has a coin-receiving opening in the top thereof which slot is exposed for receiving a coin dropped into the same when said vehicle is in said coin-receiving position, and said housing being provided with a roof-forming portion overhanging said vehicle when in said coin-ejecting position whereby a coin cannot be easily dropped into said opening in the top of said vehicle when in the latter position.

14. A coin bank comprising: a coin bank housing including a front support base and a rear portion defining a coin storage compartment behind said support base, said rear portion including a forwardly facing vertical wall extending along and above the rear of said support base, said vertical wall at the rear of said support base adjacent to said coin-receiving opening having ornamentation on a decal adhesively secured over said vertical wall, which ornamentation presents the appearance of a bank teller's station having at least one teller appearing thereon; a coin-receiving vehicle mounted for movement along the top of said front support base in a direction parallel to the front of the coin bank and from a coin-receiving position adjacent one end portion thereof to a coin-ejecting position adjacent the opposite end portion thereof, said vehicle having a coin-receiving means to receive a coin when the vehicle is in said coin-receiving position, a coin-receiving opening in said vertical wall at the rear of said support base and positioned to receive a coin ejected from said vehicle when in said coin-ejecting position; and means responsive to the movement of said vehicle to said coin-ejecting position for imparting movement to said coin-receiving means therein to eject the coin from the side of the vehicle facing said vertical wall into said coin-receiving opening therein where the coin falls into said coin storage compartment.

15. The coin bank of claim 14 wherein said decal is mounted on a decal-receiving recess on the front of said vertical wall.

* * * * *